US005836781A

United States Patent [19]

Hyzin

[11] Patent Number: 5,836,781

[45] Date of Patent: Nov. 17, 1998

[54] CONNECTOR QUICK COUPLING/ DECOUPLING MECHANISM

[75] Inventor: Peter Joseph Hyzin, Lake Forest, Calif.

[73] Assignee: ITT Manufacturing Enterprises, Inc., Wilmington, Del.

[21] Appl. No.: 808,200

[22] Filed: Feb. 28, 1997

[51] Int. Cl.[6] ..... H01R 4/50

[52] U.S. Cl. ..... 439/348; 439/953

[58] Field of Search ..... 439/348, 953, 439/372

[56] References Cited

U.S. PATENT DOCUMENTS

| | | | |
|---|---|---|---|
| 2,009,371 | 7/1935 | Junge | 287/53 |
| 2,574,456 | 11/1951 | Anderson et al. | 173/328 |
| 3,085,219 | 4/1963 | Bass, Jr. | 339/15 |
| 3,599,167 | 8/1971 | Adrian et al. | 439/348 |
| 3,631,377 | 12/1971 | Bell | 339/91 |
| 3,793,685 | 2/1974 | Knecht | 439/348 |
| 3,964,771 | 6/1976 | Baudouin | 285/315 |
| 4,083,619 | 4/1978 | McCormick et al. | 439/953 |
| 4,792,255 | 12/1988 | McArthur et al. | 403/325 |
| 4,842,537 | 6/1989 | Villiers | 439/246 |
| 4,988,248 | 1/1991 | Flux | 411/348 |
| 5,002,500 | 3/1991 | Zuccaro et al. | 439/348 |
| 5,129,836 | 7/1992 | Ursich | 439/346 |
| 5,281,162 | 1/1994 | Ursich | 439/346 |
| 5,410,785 | 5/1995 | Huang | 24/635 |
| 5,411,402 | 5/1995 | Bethurum | 439/953 |
| 5,531,140 | 7/1996 | Chow | 81/177.85 |
| 5,683,264 | 11/1997 | Hobgood et al. | 439/953 |
| 5,702,266 | 12/1997 | Jones | 439/953 |
| 5,775,931 | 7/1998 | Jones | 439/372 |

FOREIGN PATENT DOCUMENTS 0 515 072 11/1992 European Pat. Off. .

*Primary Examiner*—Paula Bradley
*Assistant Examiner*—Tho D. Ta
*Attorney, Agent, or Firm*—Thomas L. Peterson

[57] ABSTRACT

A connector system is provided which enables a first connector (12), especially a rectangular one, to be quickly locked and unlocked from a second connector (14). A button (70) of a locking device (60), lies at a side (72) of the first connector housing (30), so access to it is not greatly limited by conductors (34) extending from the rear of the first connector. When the button is depressed, it operates a mechanism that allows retraction of lock balls (100) to unlock. Depression of the button causes a plunger (110) fixed to the button to move deeper into a slot (122) of a shaft (90) and to press against an inclined wall (112) at an end of the slot to move the shaft.

2 Claims, 3 Drawing Sheets

CONNECTOR QUICK COUPLING/ DECOUPLING MECHANISM

BACKGROUND OF THE INVENTION

It is often considered desirable to provide a lock mechanism that locks a pair of connectors together after they have been mated. Threaded nuts lying around round connectors are commonly used to lock two connectors together, but it is more difficult to use this approach in holding two rectangular connectors together, the rectangular connectors having a greater height than width. Also, it can be tedious to properly threadably engage and turn a nut. Sometimes, screws are provided at the top and bottom of rectangular connectors, but turning both screws is tedious, and if they are not turned together then the connectors can be misaligned and the contacts damaged. Furthermore, in rectangular connectors, a large number of wires or other conductors extend from the rear of the connectors, and make it difficult to have access to the area behind a connector. A locking mechanism, especially for rectangular connectors, which was obvious to operate and which could be operated in a simple matter from a location other than the rear of the connector at the wires extending from the connector, would be of value.

SUMMARY OF THE INVENTION

In accordance with one embodiment of the present invention, a connector system is provided with a latching device for locking first and second connectors together when they have been mated, wherein the latching device is easily operated and where its operation is obvious to the technician. A first connector has a front that mates to the second connector, a rear from which a plurality of conductors extend, and laterally opposite sides. A push button is located at a first of the sides and is depressable to operate a latching device that locks the first connector to the second one. During mating of the connectors, a technician depresses the button while pushing the first connector against the second to mate them. The technician then releases the button, and the latching device then automatically locks the connectors together. To unmate the connectors, the technician places his hand around the top or bottom of the first connector to depress the button, and pulls the first connector away from the second one. During such unmating, depression of the button again operates the latching device to its release position to permit unmating.

The latching device is of the type that includes a shaft that can slide in forward and rearward directions within a passage, and a plurality of lock balls that lie in openings of a sleeve that surrounds the front end of the shaft and that can be pushed outward by the shaft. The shaft has a slot that receives a plunger extending from the button. When the button and plunger thereon are depressed, the plunger moves against an inclined surface at an end of the slot, and thereby causes the shaft to slide.

The novel features of the invention are set forth with particularity in the appended claims. The invention will be best understood from the following description when read in conjunction with the accompanying drawings.

DESCRIPTION OF THE PREFERRED EMBODIMENT

Figure 1:
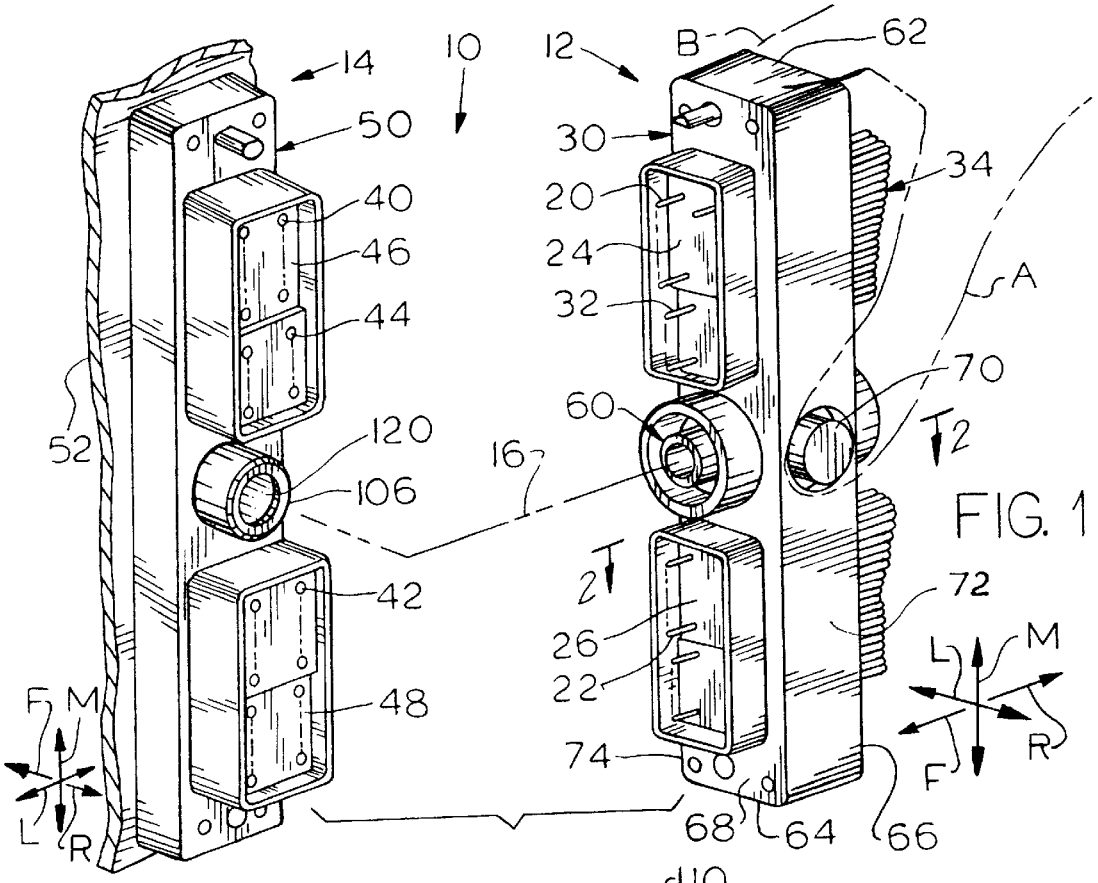
FIG. 1 is an exploded isometric view of a connector system of the present invention, showing first and second connectors thereof that can mate.

FIG. 1 illustrates a connector system 10 which includes first and second connectors 12, 14 that can be mated by moving them together along a mating axis 16, as by moving the first connector 12 in a forward direction F relative to the second connector 14. Each connector is of substantially rectangular shape when viewing the mating face of it, and has a small lateral width in the lateral direction L and a larger longitudinal length in the longitudinal direction M. The first connector has two sets of contacts 20, 22 which are longitudinally spaced apart, and that each lies in a corresponding one of two inserts 24, 26. Each insert lies in a first connector housing 30 that is constructed of metal and that is longitudinally elongated. Each of the contacts has a front end 32 that is exposed at the front of the connector, and has a plurality of conductors 34 that extend rearwardly from the rear of the connector, the particular conductors 34 shown being in the form of conductive cores with insulation around each one. Other conductors can be arranged in cables, or can be optical fibers. The second connector 14 is similarly constructed, with two sets of contacts 40, 42 having mating ends 44 that can mate with the contacts of the first connector. The contacts of the second connector are held in inserts 46, 48 that mount on a second connector housing 50. The particular second connector 14 is shown mounted on a panel 52 that fixes its position, so mating and unmating is accomplished by movement of the first connector.

The system includes a latching device 60 that locks the two connectors together when they have been mated. Such locking prevents the connectors from unmating due to vibrations, rearward tugging on the conductors 34, etc. One prior art approach to locking the connectors, has involved turning screws at the longitudinal ends or top and bottom 62, 64 of the housing. This has a disadvantage that both screws had to be turned together to prevent cocking of the connectors and damage to the contacts. Also, locking and unlocking was tedious, due to the need to turn two screws. Another approach that applicant has used is to provide a shaft with a handle projecting from the rear end 66 of the first housing, and which could be moved forward or rearward to control a device projecting from the first housing front end 68, to lock and unlock the connectors. This device had the disadvantage that there could be interference from the conductors 34 at the rear of the connector. Also, technicians who are not acquainted with the device were sometimes not sure as to whether to turn or slide the device, or which direction causes locking or unlocking.

Applicant simplifies operation of the latching device 60 by providing a button 70 at one of the two opposite lateral sides 72, 74 of the first connector housing 30 which is of rectangular shape as seen in a front elevation view. A technician can place a finger A against the button 70 to depress it, and at the same time can place another finger B at the opposite side of the first housing, to grasp the first connector and move it forwardly so it mates with the second one. After the connectors are mated, the technician removes his hand, which released the button and locks the connectors together. When the technician wishes to unmate the first connector 12 from the second one, he again depresses the button 70, as by placing his fingers A, B on laterally opposite sides of the first connector housing. With the button 70 depressed the connectors are unlocked, so when the technician applies a force in the rearward direction R he pulls the connectors apart. The connectors have a total height, between their top and bottom 62, 64, which is about four inches, so a technician can readily grasp the connector while operating the latching device, as shown in FIG. 1. For larger connectors, the technician may wish to use two hands, one to depress the button 70 and the other to grasp and pull the first connector housing.

Figure 2:
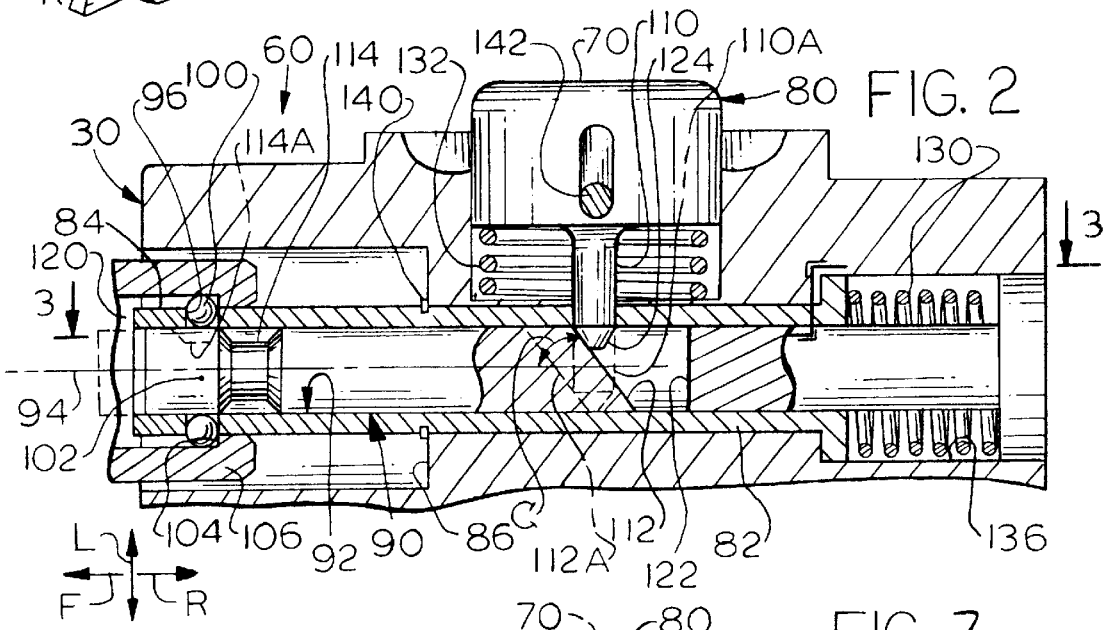
FIG. 2 is a partial sectional view taken on line 2—2 of FIG. 1 and showing a portion of the second connector, wherein the connectors are fully mated.
Figure 3:
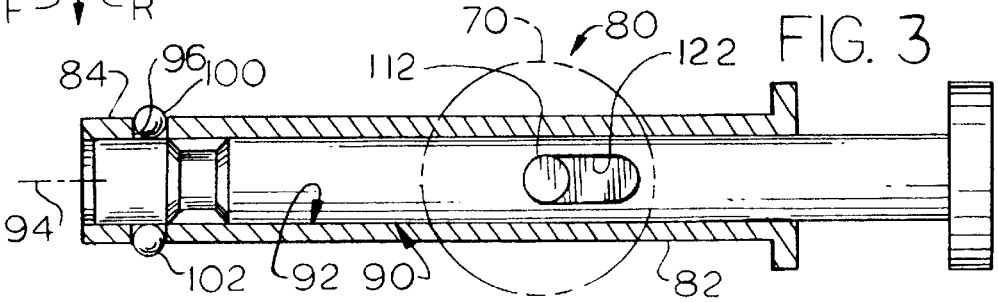
FIG. 3 is a view taken on line 3—3 of FIG. 2, but showing only the shaft, sleeve, and lock balls, with the outline of the button shown in phantom lines.
Figure 4:
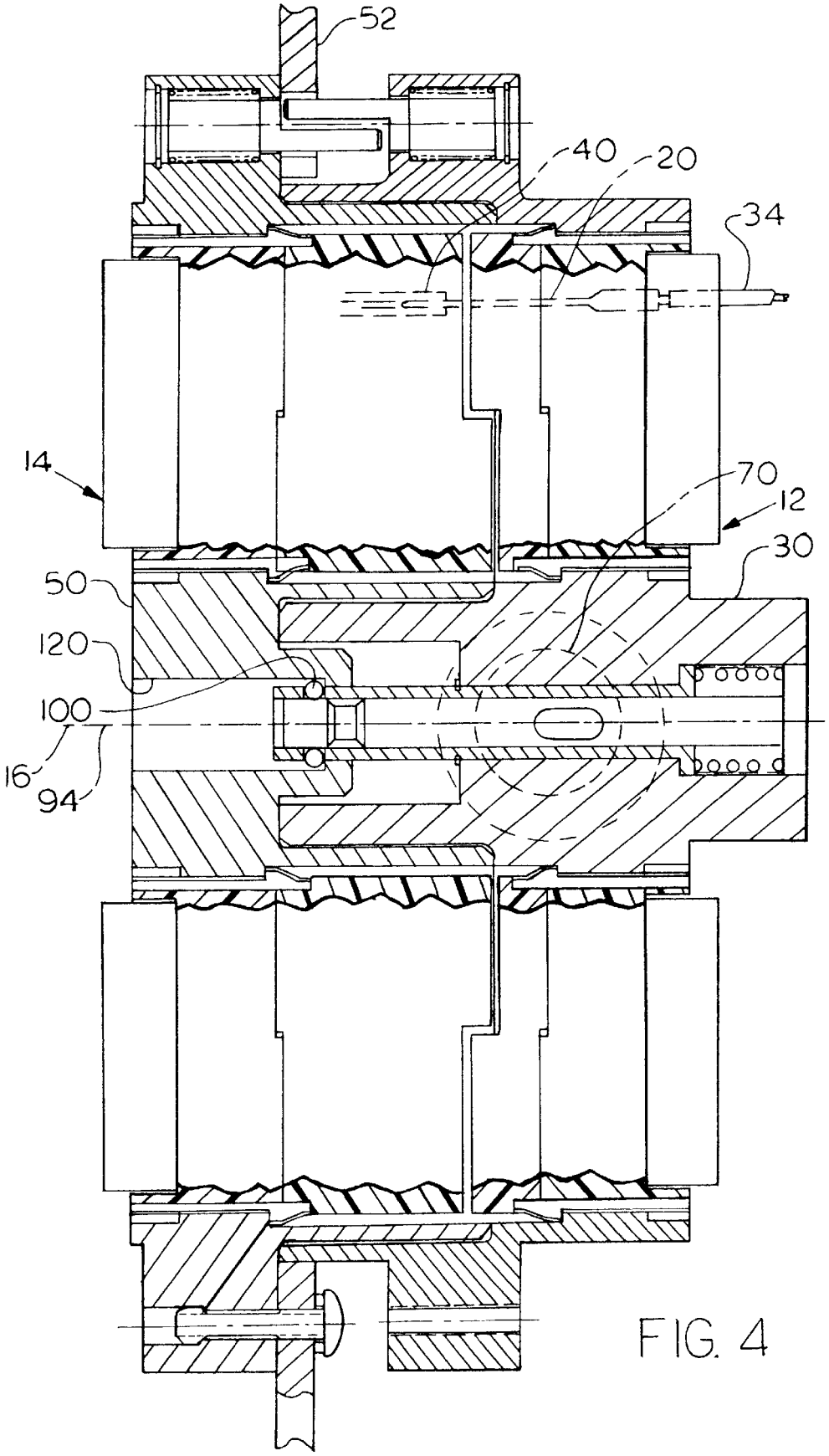
FIG. 4 is a partial sectional view of the connectors of FIG. 1, shown fully mated.
Figure 5:
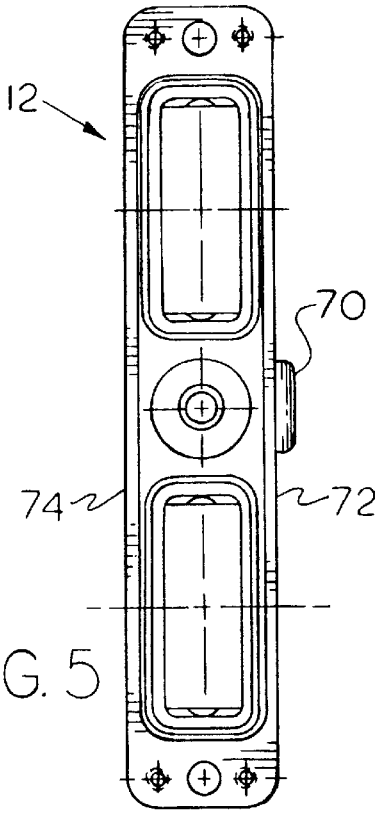
FIG. 5 is a front elevation view of the first connector of FIG. 1, but without showing the contacts or conductors.
Figure 6:
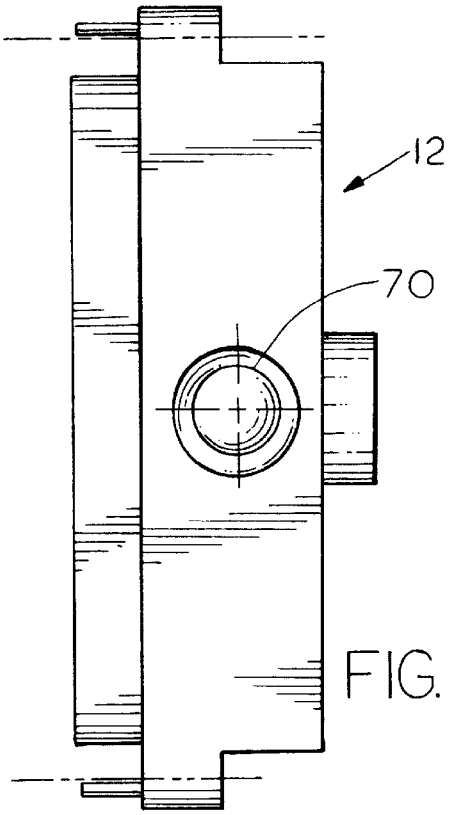
FIG. 6 is a side elevation view of the connector of FIG. 5.
Figure 7:
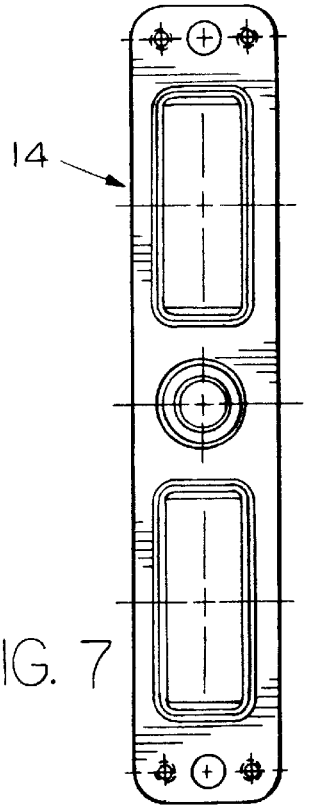
FIG. 7 is a front elevation view, showing the mating surface, of the second connector of FIG. 1, but without the contacts or conductors.
Figure 8:
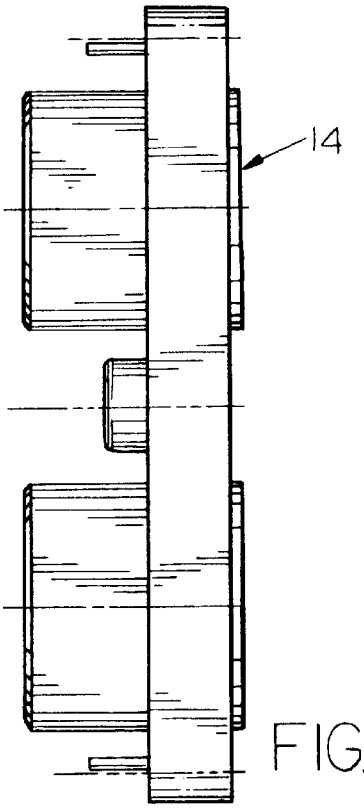
FIG. 8 is a side elevation view of the connector of FIG. 7.

FIGS. 2 and 3 show details of the latching mechanism, including the push button 70 which is part of an actuator 80. The latching device includes a sleeve 82 which is fixed in position and is part of the first housing 30, with a front portion or end 84 of the sleeve projecting forwardly from an adjacent surface 86 of the housing. A shaft 90 lies in a passage 92 formed in the sleeve, and can slide in forward and rearward directions F, R along the axis 94 of the passage. The projecting forward end 84 of the sleeve has radial openings or holes 96 which receive lock members in the form of balls 100. In the locked position shown in FIG. 2, an outer push surface 102 of the shaft lies immediately radially inward of the openings 96 and balls 100, and keeps the balls in radially outward positions, wherein parts of the balls project radially outward of the outer surface of the sleeve part 84. In this position, the lock balls lie directly forward of a forwardly-facing latch shoulder 104 on a housing part 106 of the second connector housing. This prevents the connectors from separating.

When the button 70 on the actuator 80 is depressed, or pushed laterally L toward the opposite side of the first connector housing, a plunger 110 on the actuator moves against a ramp surface 112 formed on the shaft. When the button has been fully depressed so the plunger assumes the position 110A, the ramp assumes the position 112A, with the shaft having been shifted forward. In its forwardly shifted position, a recess 114 in the shaft has moved to the position 114A, wherein it lies within the lock balls 100. The lock balls then can move radially inwardly along the openings 96, so the balls do not project from the outside of the sleeve front end 84, or project only minimally. In this release position of the latching device, the sleeve front portion 84 can be withdrawn from a receiving cavity 120 at the mating face of the second connector, and the first connector can be disconnected or unmated from the second one.

As also shown in FIG. 3, the ramp surface 112 is formed by the front end of a slot 122 in the shaft 90. The plunger 110 has about the same width as the slot 122 and has a lower actuator tip 124. The ramp surface 112 faces partially rearwardly and partially towards the button 70, with the ramp surface extending at an angle C of about 55° from the axial direction of axis 94. The angle C should be between 10° and 80°, with greater than 10° required so friction does not prevent shaft movement, and with less than 80° required so there is appreciable shaft movement. The slot 122 is relatively simple to machine, while the plunger 110 is simple to form, as by injection molding. A coil spring 130 urges the shaft rearwardly, so the front end of the shaft does not project much (if at all) forward of the front end of the sleeve 84 and the balls are kept in their radially outward positions. A button spring 132 urges the button away from its depressed position. The combination of sleeve 82, shaft 90, lock balls 100, and spring 130, can be readily installed by moving them forwardly into a hole 136 in the rest of the housing, with a retaining ring 140 holding the sleeve in position. The actuator 80 is also installed, and retained by a cross rod 142, to retain the shaft.

Thus, the invention provides a first connector, especially one of the rectangular type, which includes a latching device that enables the first connector to be locked to a second connector after mating, and to be unlocked for unmating, where the latching device can be easily operated even where there are numerous conductors extending rearwardly from the first connector. The latching device includes an actuator that has a button lying at a side of the first connector housing, with the button being depressable to unlock the connectors. The actuator includes a plunger that moves a shaft to allow lock balls to fall into a recess of the shaft so the lock balls cease to lock the first connector to the second one. The shaft has a slot that receives the actuator plunger, with one end of the slot forming an inclined ramp surface that is engaged by the plunger. Although the above description describes electrical connectors with contacts that carry signals by conduction of electricity, electrical connector contacts can be used that carry signals by electromagnetic energy such as by light waves, with the conductors being in the form of optical fibers.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector system that includes first and second connectors that each has a housing and that each has a plurality of contacts lying in the corresponding housing and having a mating end, with a plurality of conductors connected to the contacts of said first connector and extending rearwardly therefrom, and with said housings and contacts of said connectors being mateable by moving them together along a mating axis that extends in forward and rearward directions, said connector system including a latching device which can lock said connectors together when they have mated and which can be manually operated to unlock said connectors so they can be unmated, with said latching device having a manually operable actuator that can be operated to change said latching device from a lock position to an unlock position, wherein:

said first connector housing is of generally rectangular shape with a length in a predetermined longitudinal direction (M), and a width in a predetermined lateral direction (L), wherein a dimension of said width is less than a dimension of said length, and a depth in said forward and rearward directions (F,R), and said housing has laterally spaced lateral sides, and said actuator comprises a button which lies at a first of said lateral sides about halfway between opposite ends of the lateral sides, with said button being manually depressable toward the other of said lateral sides to change said latching device from said lock position to said unlock position;

the length of said lateral sides in said longitudinal direction (M) being about four inches so a person can place his/her thumb and forefinger around said conductors and press against said button and the opposite lateral side of said first housing.

2. An electrical connector system that includes first and second connectors that each has a housing and that each has a plurality of contacts lying in the corresponding housing and having a mating end, with a plurality of conductors connected to the contacts of said first connector and extending rearwardly therefrom, and with said housings and contacts of said connectors being mateable by moving them together along a mating axis that extends in forward and rearward directions, said connector system including a latching device which can lock said connectors together when they have mated and which can be manually operated to unlock said connectors so they can be unmated, with said latching device having a manually operable actuator that can be operated to change said latching device from a lock position to an unlock position, wherein:

said first connector housing is of generally rectangular shape and has laterally spaced sides spaced in a lateral direction that is perpendicular to said forward and rearward directions, and said actuator comprises a button which lies at a first of said lateral sides and which is manually depressable toward the other of said sides to change said latching device from said lock position to said unlock position;

said second connector housing has walls forming a largely rearwardly-facing latch shoulder;

said first connector housing includes walls that form a passage with a passage axis extending parallel to said mating axis, with said first connector housing walls having a sleeve-shaped front part with a radial opening that extends radial to said passage axis, and including a lock member lying in said radial opening, said latching device also includes a shaft that is slidable along said passage and that has an outer push surface to push said lock member radially out along said opening and a shaft recess to receive said lock member in radially inward movement, said push surface and said recess being spaced along said passage axis;

said shaft having slot walls forming a shaft slot, said slot walls including an inclined slot wall that extends at an incline to said radial direction and that faces partially toward said button, said button connected to a plunger that is slidable in a direction radial to said passage axis into said shaft slot and against said inclined slot wall, so depression of said button causes said shaft to slide along said passage axis and allows said lock member to move into said shaft recess.

* * * * *